United States Patent [19]

Davis et al.

[11] 4,213,744

[45] Jul. 22, 1980

[54] HYDRAULIC PUMP AND IMPROVED BY-PASS FLOW MEANS THEREFOR

[75] Inventors: Michael D. Davis, Coldwater; Harold L. Gustner, Southfield, both of Mich.

[73] Assignee: Eaton Corporation, Cleveland, Ohio

[21] Appl. No.: 883,062

[22] Filed: Mar. 3, 1978

[51] Int. Cl.[2] ..... F04B 49/08

[52] U.S. Cl. ..... 417/310

[58] Field of Search ..... 417/307-311, 417/440, 87

[56] References Cited

U.S. PATENT DOCUMENTS

| | | | |
|---|---|---|---|
| 1,738,345 | 12/1929 | Barlow | 417/307 X |
| 2,746,391 | 5/1956 | Jaworowski et al. | 417/311 X |
| 2,921,530 | 1/1960 | Aumick | 417/310 |
| 2,983,226 | 5/1961 | Livermore | 417/310 X |
| 3,359,913 | 12/1967 | Halsey | 418/133 |
| 3,415,194 | 12/1968 | Connelly | 417/310 X |
| 3,614,266 | 10/1971 | Ciampa et al. | 417/310 X |
| 3,645,647 | 2/1972 | Ciampa et al. | 417/310 X |
| 3,759,636 | 9/1973 | Schaefer et al. | 417/310 X |
| 3,806,273 | 4/1974 | Clark et al. | 417/310 X |

*Primary Examiner*—Carlton R. Croyle
*Assistant Examiner*—Edward Look
*Attorney, Agent, or Firm*—R. A. Johnston; J. Yakimow; L. Kasper

[57] ABSTRACT

A hydraulic pump is disclosed of the type including a by-pass valve to limit the fluid volume output of the pump. The by-pass valve is disposed within a portion of the pump housing which extends axially into the fluid reservoir and defines a pair of by-pass ports. The pump is preferably balanced and includes a pair of diametrically opposed inlet kidney ports. A tubular member is used to direct a portion of the by-pass fluid from each of the by-pass ports toward the adjacent inlet kidney. Each of the tubular members is disposed to direct the by-pass flow axially into the inlet kidney, thus improving filling of the pumping pockets, and reducing cavitation and the resultant noise.

12 Claims, 8 Drawing Figures

HYDRAULIC PUMP AND IMPROVED BY-PASS FLOW MEANS THEREFOR

BACKGROUND OF THE DISCLOSURE

The present invention relates to positive displacement fluid pumps of the type which may be utilized in vehicle power steering systems, and more particularly, to such pumps which include a valve means to by-pass excess output fluid.

In vehicle power steering systems, positive displacement pumps are ordinarily employed for supplying pressurized fluid to a power steering control device, with the pump being driven by the vehicle engine and operating over a widely varying range of speeds.

Hydraulic pumps of the type to which the present invention relates include a housing defining a pumping chamber and a pumping element rotatably disposed in the pumping chamber. The housing defines an inlet port communicating with the expanding pumping pockets and an outlet port communicating with the contracting pumping pockets. The housing further includes a discharge port which may be connected to a fluid operated device, such as the power steering control unit.

In pumps of the type described, the volume of fluid flowing from the outlet port increases proportionally as the speed of the engine and pump increases. Therefore, in conventional power steering pumps, a by-pass valve is disposed in the flow path between the outlet port and the discharge port. The by-pass valve is ordinarily made responsive to the fluid pressure differential generated by a metering orifice positioned adjacent the discharge port, to establish a predetermined maximum flow rate from the discharge port. The excess fluid which is by-passed at higher pump speeds is typically recirculated toward the inlet port, either by dumping the excess fluid into the reservoir adjacent the inlet port or by directing the excess fluid into some type of inlet "header" which communicates with the inlet port. Frequently, such arrangements cause cavitation within the fluid or the trapping of air within the fluid because of turbulence caused by the mixing of inlet and by-pass fluids, which are at different pressures. In either case, the result is normally cavitation within the pumping element and excessively noisy operation of the pump.

Presently, there is a trend toward the use of "balanced" power steering pumps, i.e., pumps having a pair of diametrically opposed inlet ports, and a pair of diametrically opposed outlet ports with each pumping pocket expanding twice and contracting twice during each revolution, to balance loading on the input shaft. Providing sufficient filling of the pumping pockets to avoid cavitation is especially difficult in balanced pumps.

Accordingly, it is an object of the present invention to provide a pump of the type described in which excess fluid is redirected toward the inlet ports in a manner which improves filling of the pockets and reduces cavitation.

Another trend is to provide inlet ports on each axial end of the pumping element to improve filling and reduce cavitation. In one power steering pump which is presently commercially available, a pair of drilled passageways communicates excess fluid from the by-pass valve to one adjacent inlet kidney. Although such an arrangement may be satisfactory for some pump configurations, and under certain conditions, the use of drilled passageways to redirect or recirculate excess fluid clearly has serious limitations, especially in a pump which is balanced and double-end-fed.

Accordingly, it is another object of the present invention to provide a pump of the type described which is capable of directing by-pass fluid to a pair of inlet ports at one end of the pumping element, as well as to a pair of inlet ports at the opposite end of the pumping element.

It is a further object of the present invention to provide a pump which accomplishes the above-stated object without the necessity of an extremely complex, expensive casting or excessive and expensive machining.

The above and other objects of the invention are accomplished by the provision of an improved rotary pump of the type described above. The improvement comprises means defining a by-pass flow path of generally constant cross-sectional flow area communicating the excess fluid from a by-pass port adjacent the by-pass valve. The by-pass flow path includes a terminal portion disposed adjacent the inlet port and oriented generally axially to permit at least a portion of the excess fluid into the inlet port.

DESCRIPTION OF THE PREFERRED EMBODIMENT

Figure 1:
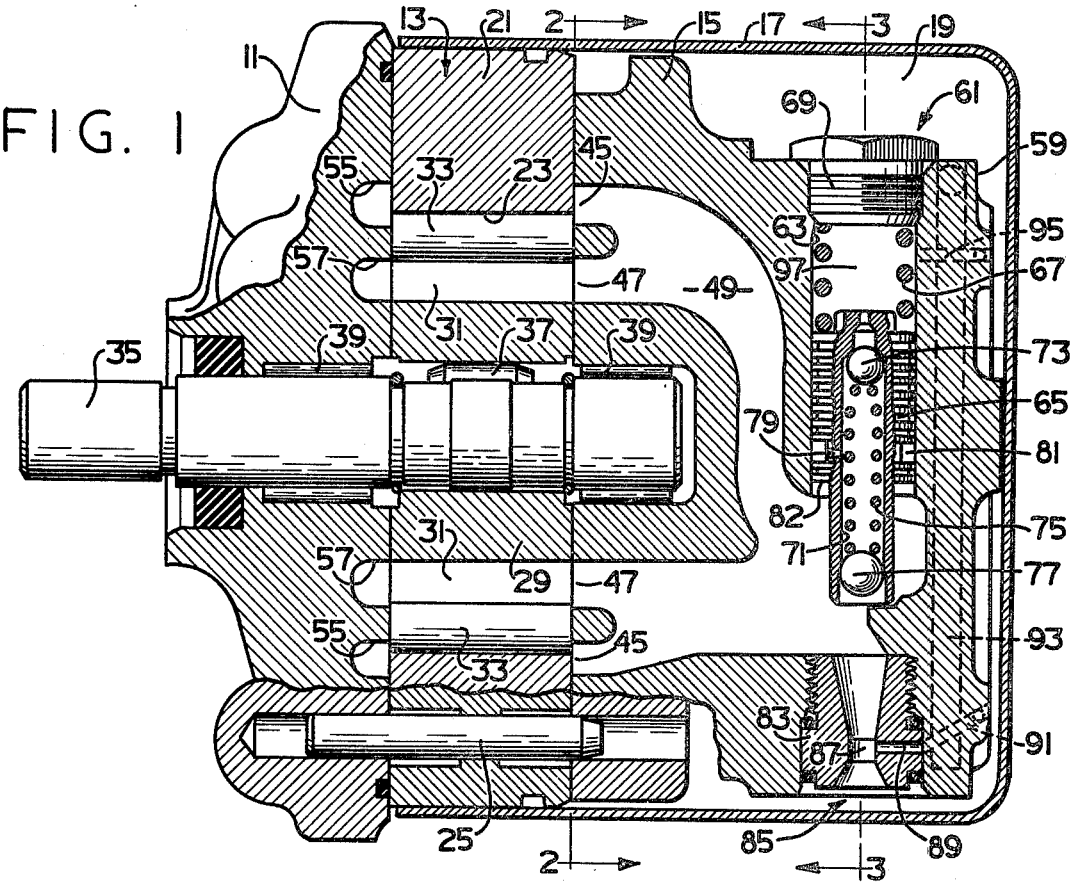
FIG. 1 is an axial cross-section of a rotary pump of the type with which the present invention may be utilized.

Referring now to the drawings, which are not intended to limit the invention, FIG. 1 is an axial cross-section of a typical automotive power steering pump of a type which is commercially available and therefore, will be described only briefly.

The pump comprises several major portions, including a cover member 11, a pumping section 13, and a valve housing 15. The pumping section 13 and valve housing 15 are surrounded by a reservoir can 17 which defines a fluid reservoir chamber 19.

The pumping section 13 includes a cam ring 21 which defines an internal cam surface 23. The cam ring 21 is held in proper circumferential alignment relative to the cover member 11 and valve housing 15 by means of a pair of axial pins 25 (FIG. 2), only one of which is shown in FIG. 1. The cam ring 21 is held in tight sealing engagement between the adjacent surfaces of the cover member 11 and valve housing 15 by means of a plurality of bolts 27 (FIG. 2).

Disposed within the cam ring 21 is a rotatable rotor member 29 which defines a plurality of radially opening pumping pockets 31, each of which contains a cylindrical roller 33. The pump includes an input shaft 35 which is capable of transmitting a rotary motion, such as from the vehicle engine, to the rotor 29, as by means of a suitable pin connection 37. The input shaft 35 is supported for rotation within the cover member 11 and valve housing 15 by sets of suitable bearings 39. As the rotor 29 rotates, the rollers 33 remain in engagement with the internal cam surface 23, which is configured to cause each of the rollers 33 to move radially outwardly and inwardly to accomplish fluid intake and fluid discharge, respectively, as is well known in the art. It should become apparent to those skilled in the art that the present invention is described in connection with a roller-vane pumping element by way of example only and that the invention is equally advantageous when used with various other types of pumping sections, such as sliding vane, slipper, and others.

Figure 2:
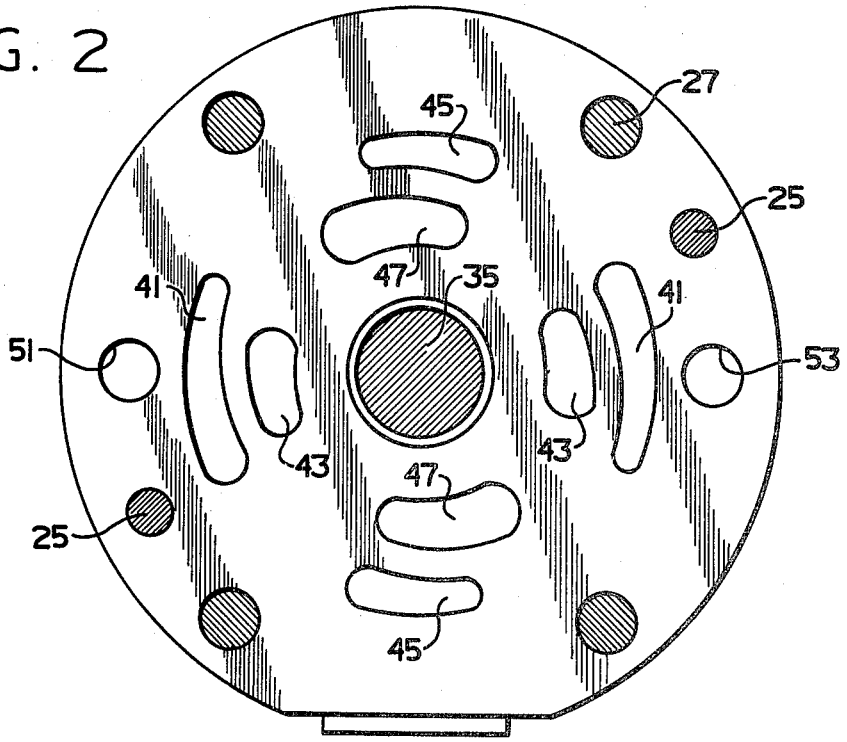
FIG. 2 is a transverse cross-section taken on line 2—2 of FIG. 1
Figure 4:
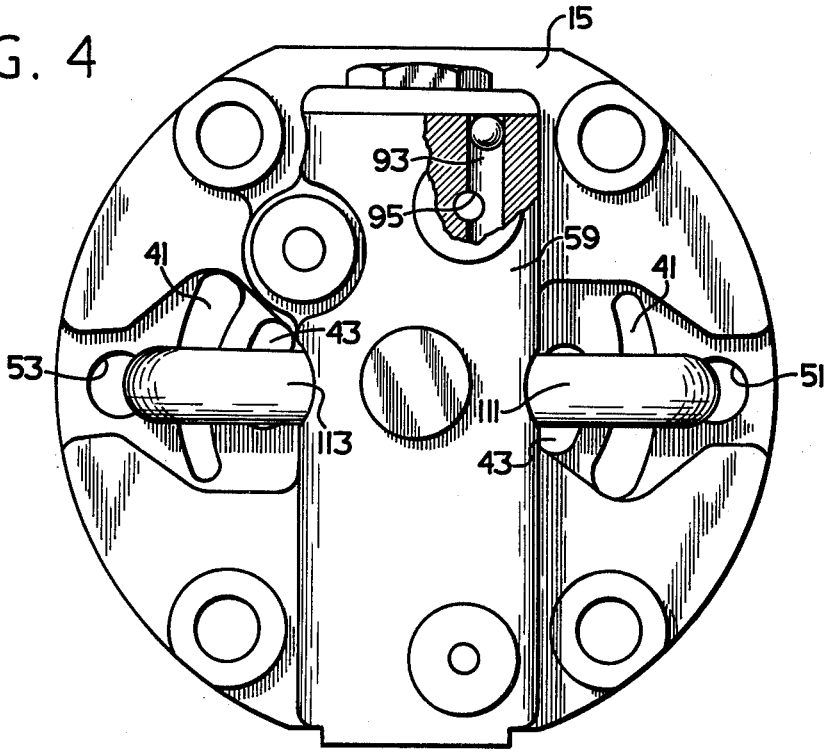
FIG. 4 is an elevation taken on line 4—4 of FIG. 1.

Referring now to FIG. 2, in conjunction with FIG. 1, the valve housing 15 defines a pair of diametrically opposed outer inlet ports 41 and a pair of diametrically opposed inner inlet ports 43 (not shown in FIG. 1). As may be seen by viewing FIGS. 4, 5, and 6, the inlet ports 41 and 43 are in direct, open communication with the fluid reservoir 19 and receive inlet fluid therefrom.

Valve housing 15 also defines a pair of diametrically opposed outer outlet ports 45, and a pair of diametrically opposed inner outlet ports 47. Pressurized fluid flowing from the contracting fluid pockets flows through the outlet ports 45 and 47 and into a discharge header 49, from where the pressurized fluid flows to a discharge port as will be described subsequently.

Referring still to FIG. 2, it will be understood by those skilled in the art that the invention is especially advantageous when used with a "balanced" pump as illustrated herein. However, the present invention is equally useful when applied to an unbalanced pump.

Referring again to FIG. 1, it may be seen that the inlet and outlet ports defined by the valve housing 15 are disposed at the "rearward" axial end of the pumping section 13, the "forward" end of the pumping section 13 being that end from which the input shaft 35 enters. Thus, the inlet ports 41 and 43 are referred to as rearward inlet ports, while the outlet ports 45 and 47 are referred to as rearward outlet ports.

Referring still to FIG. 1, the cover member 11 defines a pair of forward outer inlet ports and forward inner inlet ports (not shown in FIG. 1) which are aligned with rearward outer inlet ports 41 and inner inlet ports 43, respectively. Communication of inlet fluid from the reservoir 19 to the forward outer and inner inlet ports is by means of a pair of axial fluid feed passages 51 and 53 (FIGS. 2, 4, and 5) which are defined by the valve housing 15, the cam ring 13, and the cover member 11.

The cover member 11 further defines a pair of diametrically opposed forward outer outlet ports 55 and forward inner outlet ports 57 (FIG. 1). The forward ports 55 and 57 do not directly communicate with the discharge port, but serve mainly to balance the fluid pressure forces acting axially on the rotor 29 and rollers 33. It will be understood by those skilled in the art that, although the present invention is especially advantageous when used with a pump in which the pumping element is fed from both axial ends, it may also be used where the inlet feed to the pumping element is from only one end. In addition, the invention may be used in a pump in which the pumping element is fed radially, rather than axially as in the preferred embodiment. An example of a pump in which the fluid both enters the pumping element radially and is discharged radially is shown in U.S. Pat. No. 2,746,391.

Referring now to FIGS. 3–6, in conjunction with FIG. 1, it may be seen that the valve housing 15 includes a housing portion 59 which extends axially away from the pumping element 13 into the fluid reservoir chamber 19. Disposed within the housing portion 59 is a combination by-pass and pressure relief valve assembly, generally designated 61. The valve assembly 61 is disposed within a bore 63 defined by the housing portion 59, and includes a by-pass valve piston 65 biased toward its normally closed position by a spring 67 which is seated at its upper end against a threaded fitting 69. The bore 63 intersects the lower portion of discharge header 49, such that pressurized outlet fluid acts on the cross-sectional area of the piston 65, in opposition to the biasing force of spring 67. The valve piston 65 defines a bore 71, within which is disposed a relief ball 73, normally biased into engagement with its valve seat by a spring 75, seated at its bottom end against a retaining ball 77, which is press-fit into the bore 71. The valve piston 65 defines a radially extending relief passage 79, communicating between the bore 71 and an annular groove 81. The annular groove 81 separates a pair of lower valve lands 82 from the upper valve lands of the piston 65.

In threaded engagement with the housing portion 59 is a metering orifice member 83 which communicates pressurized fluid from the discharge header 49 to a discharge port 85. The member 83 defines a metering orifice 87 of reduced cross-section, and a radial passage 89 which normally communicates a static pressure signal, representative of the pressure in the orifice 87, by means of a series of drilled signal passages 91, 93, and 95 to a signal chamber 97 adjacent the upper end of the valve piston 65.

Figure 3:
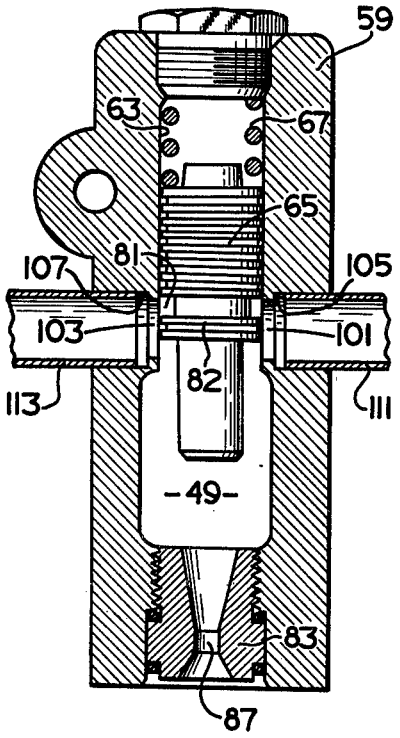
FIG. 3 is a transverse cross-section taken on line 3—3 of FIG. 1, but with the valve piston in the by-pass position.

As may best be seen in FIG. 3, the housing portion 59 defines a pair of diametrically opposed by-pass ports 101 and 103 which intersect the valve bore 63. The structure which has been described up until this point of the specification is generally well known in the prior art. Conventionally, as was described in the background of the specification, any excess fluid flowing out of one or more by-pass ports has been dumped into the fluid reservoir, or into some form of inlet header, where pressurized excess fluid and atmospheric pressure inlet fluid are mixed, frequently resulting in turbulence. The present invention relates to an improvement in the manner of directing excess fluid from the by-pass ports 101 and 103 back into the inlet ports to improve filling of the expanding pumping pockets and reduce the noise level.

Prior to a description of the novel aspects of the present invention, the operation of the combination by-pass and pressure relief valve assembly 61 will be described. At relatively low engine speeds, the valve piston 65 is in the position shown in FIG. 1 in which the lands 82 block fluid communication between the discharge header 49 and the by-pass ports 101 and 103. As engine speed and pump speed increase, the flow through the metering orifice 87 increases until the pressure on the underside of the valve piston 65 is sufficient to overcome the biasing force of spring 67 and the fluid pressure in chamber 97, and force the valve piston 65 to a by-pass position (exaggerated in FIG. 3 for ease of illustration). In the by-pass position, all "excess" fluid, i.e., fluid in excess of the maximum, predetermined discharge rate, is permitted to flow from the discharge header 49 past the land 82 and into the by-pass ports 101 and 103.

The other function of the valve assembly 61 is to act as a high pressure relief valve, primarily in the event of a blockage in the flow path of the steering system, or if an attempt is made to turn the steering wheels against an obstruction.

In either case, the excessive pressure buildup is transmitted back through the metering orifice 87 and the passages 89, 91, 93, and 95 to the chamber 97. If the pressure exceeds the setting on the relief ball 73 (e.g., 1500 to 1700 psi, typically), the ball 73 is unseated, and the fluid flows past the ball 73, through the relief passage 79 into the annular groove 81 and out the by-pass ports 101 and 103. The annular groove 81 is positioned to communicate with the by-pass ports 101 and 103 in any of the normal positions of the by-pass valve piston 65. The flow of high pressure fluid past the ball 73 is intended primarily as a "pilot" flow, which serves to lower the pressure in chamber 97, thus permitting the fluid pressure acting on the underside of the valve piston 65 to bias the piston to a relief or dump position, similar to that shown in FIG. 3.

Referring now primarily to FIGS. 3–6, the improved by-pass flow arrangement of the present invention will be described. As may best be seen in FIGS. 3 and 5, the housing portion 59 defines a pair of diametrically opposed bores 105 and 107 in fluid communication with the by-pass ports 101 and 103, respectively. A pair of tubular members 111 and 113 have their "upstream" ends received within the bores 105 and 107, respectively. The tubular members 111 and 113 receive excess fluid from the by-pass ports 101 and 103, respectively, each of the members 111 and 113 providing a generally smooth flow path of relatively constant cross-sectional area to permit the flow of excess fluid therethrough (arrows, FIG. 5). Each of the tubular members 111 and 113 preferably has its upstream portion received within the bores 105 and 107 in sufficiently tight engagement therewith to prevent movement of the members 111 and 113 relative to the housing portion 59. Such engagement may be accomplished by means of a press-fit, or by the use of some type of adhesive material, weld or snap-ring.

Figure 5:
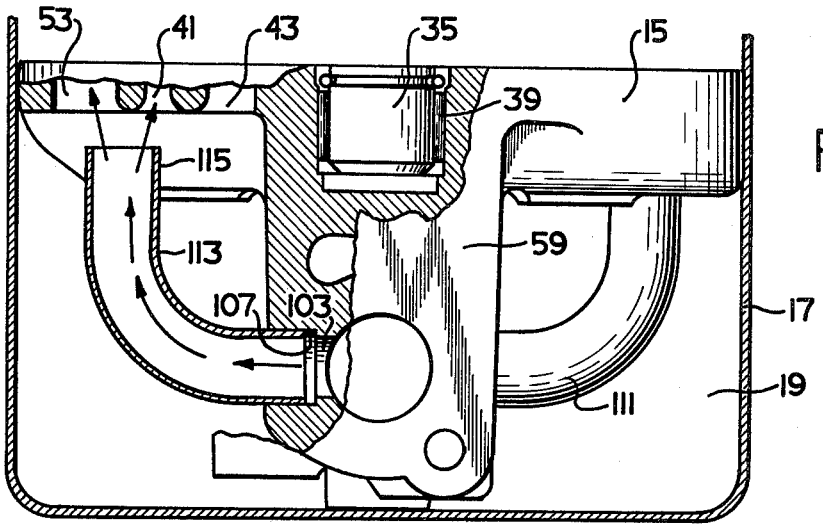
FIG. 5 is a top plan view of the valve housing subassembly, partially broken away.
Figure 6:
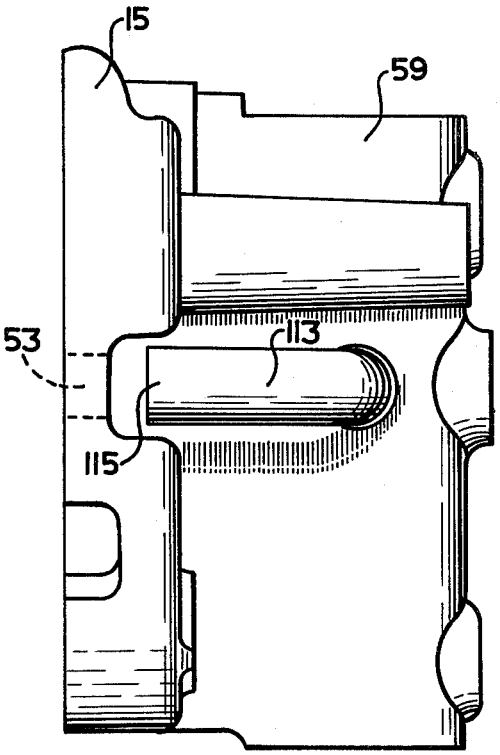
FIG. 6 is a left side elevation of the valve housing subassembly.

As may best be seen in FIGS. 5 and 6, each of the tubular members 111 and 113 is cantilevered and includes a terminal portion 115, such that the terminal portion of the by-pass flow path is oriented axially, to direct the by-pass flow in such a direction that the momentum of the flow will accomplish the maximum possible filling of the expanding pumping pockets.

In the preferred embodiment, because the pumping section 13 is fed from both axial ends, the terminal portion 115 of tubular member 113 is disposed to direct a portion of the by-pass flow into the axial fluid feed passage 53, to fill the expanding pockets through the forward inlet ports, with the remainder of the by-pass fluid being directed into the rearward outer inlet port 41 (arrows, FIG. 5). As may be seen in FIG. 4, the positioning of the tubular member 111, and its terminal portion, is the same relative to the axial fluid feed passage 51 and the outer inlet port 41.

As may best be seen in FIG. 5, the tubular members 111 and 113 provide by-pass flow paths which extend through the fluid reservoir chamber 19 without permitting the by-pass fluid and reservoir fluid to intermix, until the by-pass fluid is flowing axially toward the inlet port and is close enough thereto that its momentum is normally effective to also draw adjacent reservoir fluid into the port, rather than mixing therewith turbulently. Accordingly, in practicing the present invention, it is fairly important to select an appropriate axial distance from the end of the terminal portion 115 to the inlet port 41 and passage 53 to achieve optimum benefit from the flow momentum of the by-pass fluid. It is believed that such a selection would be obvious, or could be determined without undue experimentation by one skilled in the art, from a reading and understanding of this specification.

It is also believed obvious in view of this specification to select an appropriate diameter of the tubular members 111 and 113, based upon the range of flow rates to be by-passed therethrough, to achieve a desired fluid restriction (or pressure drop) over the length of the tubular member. Also, when the invention is being utilized in a double-end-fed pump, it should be apparent that the lateral position of the terminal portion 115 may be adjusted to adjust the proportion of by-pass fluid flowing into inlet port 41 versus the proportion of by-pass fluid entering the axial feed passage 53. Further, in regard to the positioning of the tubular members 111 and 113, although the terminal portions 115 are illustrated herein as perfectly perpendicular to the plane of the inlet ports 41, it is clearly within the scope of the invention, and within the meaning of the term "axially" as used in the appended claims, to orient the terminal portions 115 at an angle slightly greater or less than 90 degrees, to maximize filling of the expanding pockets.

Figure 7:
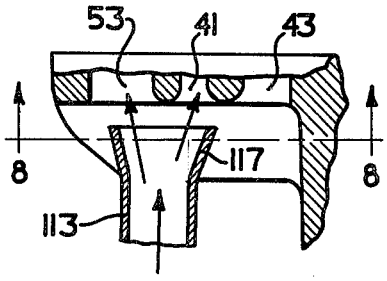
FIG. 7 is a fragmentary view, similar to FIG. 5, illustrating an alternative embodiment of the invention.
Figure 8:
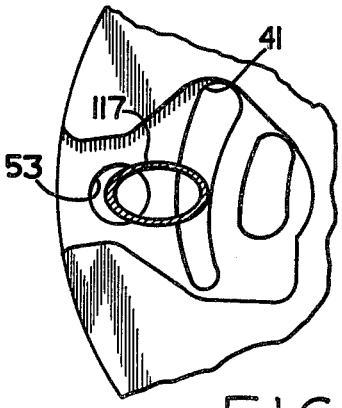
FIG. 8 is a transverse cross-section taken on line 8—8 of FIG. 7.

Referring now to FIGS. 7 and 8, there is illustrated a particular alternative embodiment, having as its object an even more efficient filling of the expanding pockets. In FIGS. 7 and 8, the invention is identical to that disclosed in FIGS. 3–6, except that the tubular members 111 and 113 no longer have a substantially circular cross-section over their entire length. Instead, each of the tubular members has a terminal portion 117 of generally oval cross-section, to increase the lateral extent of the terminal portion and the by-pass flow, relative to the inlet port 41 and feed passage 53, without changing substantially the flow area of the by-pass flow path. It will be appreciated that various other modifications of the terminal portions could be utilized to improve the fill characteristics of the invention.

Although the invention has been described in connection with a pump of the integral-reservoir type, with the tubular members 111 and 113 passing through the reservoir chamber 19, it should be apparent that the invention is not so limited, and it is essential only that the fluid reservoir be in open communication with the inlet port, whether directly or by way of an inlet passage or header.

In the subject embodiment, the tubular members 111 and 113 comprise rigid steel tubes, with the terminal portions being cantilevered (unsupported). It is also within the scope of the invention to utilize various other rigid tubular materials, and also, to utilize various softer materials of the type which could be molded into the desired shape. The use of molded tubular members would facilitate the use of various configurations other than those shown herein. For example, a molded tubular member could separate into a pair of transversely-spaced tubular portions, one of which would be aligned with the inlet port, and the other of which would be aligned with the feed passage 53.

It should be apparent from the foregoing specification that the present invention provides an improved arrangement for directing excess fluid from the by-pass valve into the inlet ports to improve filling of the expanding pockets while reducing the operating noise of the pump. By the use of the present invention, this improved performance can be achieved without the need for a complex casting or extensive machining especially in the case of balanced and double-end-fed pumps.

What is claimed is:

1. In a rotary pump of the type including housing means defining a pumping chamber, a pumping element rotatably disposed in the pumping chamber and defining an axis of rotation, expanding fluid pockets and contracting fluid pockets, the housing means defining a fluid inlet port in communication with the expanding pockets, a fluid outlet port in communication with the contracting pockets, a discharge port for connection to fluid operated apparatus, and a discharge fluid path communicating between the outlet port and the discharge port, means defining a fluid reservoir in open communication with the inlet port and disposed axially adjacent thereto, valve means operable to bypass excess fluid from the discharge fluid path through a bypass port, the improvement comprising: means defining a bypass flow path of generally constant cross-sectional flow area communicating said excess fluid from said bypass port, said bypass flow path including a terminal portion disposed adjacent said inlet port, the cross-sectional area of said terminal portion overlapping the cross-sectional area of said inlet port when the area of said terminal portion is projected in a normal direction to permit at least a portion of said excess fluid to flow directly into said inlet port, said means defining said bypass flow path being disposed within said fluid reservoir and substantially surrounded thereby.

2. A pump as claimed in claim 1 wherein said housing means includes a valve housing portion extending in a direction axially away from said pumping chamber and into said fluid reservoir, said valve means being disposed in said valve housing portion.

3. A pump as claimed in claim 2 wherein said valve housing portion defines said bypass port, said bypass port being oriented to direct the flow of said excess fluid away from said valve means generally perpendicular to said axis of rotation.

4. A pump as claimed in claim 3 wherein said means defining said bypass flow path comprises a generally tubular member connected to said valve housing portion adjacent said bypass port.

5. A pump as claimed in claim 3 wherein said fluid inlet port comprises first and second diametrically opposed fluid inlet ports, said valve housing portion defines first and second bypass ports oppositely disposed about said valve means, and said means defining said bypass flow path comprises means defining a first bypass flow path communicating a first portion of said excess fluid from said first bypass port toward said first fluid inlet port, and a second bypass flow path communicating a second portion of said excess fluid from said second bypass port toward said second fluid inlet port.

6. A pump as claimed in claim 1 wherein said means defining said bypass flow path comprises a tubular member having one end attached to said housing means adjacent said bypass port and in fluid communication therewith.

7. A pump as claimed in claim 1 wherein said fluid inlet port is disposed adjacent the rearward axial end of said pumping element, said housing means defining a fluid inlet port disposed adjacent the forward axial end of said pumping element and an axial passage having a rearward end communicating with said fluid reservoir and a forward end communicating with said forward fluid inlet port.

8. A pump as claimed in claim 7 wherein said rearward end of said axial passage is disposed adjacent said rearward fluid inlet port, said terminal portion of said bypass flow path being disposed to direct one portion of said excess fluid into said rearward fluid inlet port and another portion into said axial passage.

9. In a rotary pump of the type including housing means defining a pumping chamber, a pumping element rotatably disposed in the pumping chamber and defining an axis of rotation, expanding fluid pockets and contracting fluid pockets, the housing means defining a fluid inlet port in communication with the expanding pockets, a fluid outlet port in communication with the contracting pockets, a discharge port for connection to fluid operated apparatus, and a discharge fluid path communicating between the outlet port and the discharge port, means defining a fluid reservoir in open communication with the inlet port, and valve means operable to by-pass excess fluid from the discharge fluid path through a by-pass port, the valve means including a valve member operable to move along a path oriented generally perpendicular to the axis of rotation of the pumping element, the improvement comprising:

an elongated tubular member defining a by-pass flow path of generally constant cross-sectional flow area, said tubular member including an upstream portion attached to said housing means adjacent said by-pass port, and in fluid communication therewith, said tubular member including a terminal portion disposed adjacent said inlet port and oriented generally perpendicular thereto to permit at least a portion of said excess fluid to flow into said inlet port.

10. A pump as claimed in claim 9 wherein said by-pass port is oriented to direct the flow of said excess fluid away from said valve means generally perpendicular to the axis of rotation.

11. A pump as claimed in claim 10 wherein said fluid inlet port comprises first and second diametrically opposed fluid inlet ports, said housing means defining first and second by-pass ports oppositely disposed about said valve means, said tubular member defining said by-pass flow path communicating a first portion of said excess fluid from said first by-pass port toward said first fluid inlet port, and including a second tubular member defining a second by-pass flow path communicating a second portion of said excess fluid from said second by-pass port toward said second fluid inlet port.

12. In a rotary pump of the type including housing means defining a pumping chamber, a pumping element disposed in the pumping chamber and defining expanding fluid pockets and contracting fluid pockets, the housing means defining forward and rearward fluid inlet ports in communication with the forward and rearward ends of the expanding pockets, respectively, a fluid outlet port in communication with the contracting pockets, a discharge port for connection to fluid operated apparatus, and a discharge fluid path communicating between the outlet port and the discharge port, means defining a fluid reservoir in direct, open communication with said rearward inlet port, and valve means operable to by-pass excess fluid from the discharge fluid path through a by-pass port, the improvement comprising:

(a) said housing means defining an axial passage having a forward end in fluid communication with said forward inlet port and a rearward end in fluid communication with said fluid reservoir and disposed adjacent said rearward inlet port; and (b) an elongated tubular member defining a by-pass flow path, and including an upstream portion attached to said housing means adjacent said by-pass port, and in fluid communication therewith, said tubular member including a terminal portion disposed adjacent said rearward inlet port and oriented to direct one portion of said excess fluid into said rearward inlet port and another portion of said excess fluid into said axial passage.

* * * * *